US010173869B2

(12) United States Patent
Moore et al.

(10) Patent No.: US 10,173,869 B2
(45) Date of Patent: Jan. 8, 2019

(54) GRAVITY ACTUATED CRANE STOP

(71) Applicant: Manitowoc Crane Companies, LLC, Manitowoc, WI (US)

(72) Inventors: Ian M. Moore, Manitowoc, WI (US); Derrick L. Geiser, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 465 days.

(21) Appl. No.: 14/965,462

(22) Filed: Dec. 10, 2015

(65) Prior Publication Data

US 2016/0167934 A1 Jun. 16, 2016

Related U.S. Application Data

(60) Provisional application No. 62/091,213, filed on Dec. 12, 2014.

(51) Int. Cl.
*B66C 23/92* (2006.01)
*B66C 23/64* (2006.01)

(52) U.S. Cl.
CPC ..... *B66C 23/92* (2013.01); *B66C 23/64* (2013.01)

(58) Field of Classification Search
CPC ..... B66C 23/06; B66C 23/16; B66C 23/66; B66C 23/68; B66C 23/92
See application file for complete search history.

(56) References Cited

U.S. PATENT DOCUMENTS 3,123,223 A * 3/1964 Markwardt et al. .... B66C 23/92 212/293
3,561,610 A * 2/1971 Buckert ..... B66C 23/92 212/280
4,270,663 A * 6/1981 Berger ..... B66C 23/92 212/293

(Continued)

FOREIGN PATENT DOCUMENTS

CN 2801750 Y 8/2006
CN 201932852 U1 8/2011

(Continued)

OTHER PUBLICATIONS

Extended European Search Report dated May 2, 2016, in European Application No. 15199032.2.

(Continued)

*Primary Examiner* — Emmanuel M Marcelo
(74) *Attorney, Agent, or Firm* — Ramey & Schwaller, LLP; Craig Buschmann

(57) ABSTRACT

A gravity actuated crane stop for a crane is disclosed. The gravity actuated crane stop has a first connector at a first end configured to couple to a first crane member and an interface at a second end configured to interface with a second crane member. A gravity actuated mechanism is disposed on the body and has a first configuration in which gravity actuated mechanism disables the interface, and a second configuration in which the gravity actuated mechanism does not disable the interface. The gravity actuated mechanism is automatically changeable from the first configuration to the second configuration as the body is moved from a first orientation relative to a horizontal plane to a second orientation relative to the horizontal plane.

18 Claims, 4 Drawing Sheets

(56) References Cited

U.S. PATENT DOCUMENTS

2010/0243595 A1 9/2010 Walker et al.

FOREIGN PATENT DOCUMENTS

| | | | | | |
|---|---|---|---|---|---|
| DE | 927406 | C | * | 5/1955 | ..... B66C 23/92 |
| DE | 927406 | C | | 5/1955 | |
| EP | 2253577 | A1 | * | 11/2010 | ..... B66C 23/92 |
| EP | 2253577 | A1 | | 11/2010 | |
| NL | 1022902 | C2 | | 9/2004 | |

OTHER PUBLICATIONS

Office Action dated May 28, 2018, in Chinese Application No. 2015110360417.

* cited by examiner

GRAVITY ACTUATED CRANE STOP

RELATED APPLICATIONS

The present patent document claims the benefit of the filing date under 35 U.S.C. § 119(e) of Provisional U.S. Patent Application Ser. No. 62/091,213, filed Dec. 12, 2014, which is hereby incorporated by reference.

BACKGROUND

The present invention relates to a gravity actuated stop for use with a crane component, such as a boom stop used on a mobile lifting crane, and more particularly to stop having a gravity actuated mechanism requiring no user intervention or external power source.

Lift cranes typically include a carbody; ground engaging members elevating the carbody off the ground; a rotating bed rotatably connected to the carbody such that the rotating bed can swing with respect to the ground engaging members; and a boom pivotally mounted on the rotating bed, with a load hoist line extending there from. For mobile lift cranes, the ground engaging members are moveable ground engaging members. There are different types of moveable ground engaging members, most notably tires for truck mounted cranes, and crawlers. Typically the mobile lift cranes include a counterweight to help balance the crane when the crane lifts a load.

A crane with a pivotable boom will typically include at least one stop member, such as a boom stop, which is used to prevent a crane component from inadvertently moving into a particular orientation. For example, a boom stop may prevent a boom from rotating into a near vertical orientation and a jib stop may similarly prevent a jib from rotating to a near vertical position. The stops provide an extra layer of safety when the crane is in operation, but may not be necessary when the crane is not loaded. Moreover, the stops may actually be a hindrance when assembling a crane, as they may prevent movement necessary for assembly.

Currently, it is common practice to assemble a crane with at least one stop disabled. For example, when a boom and a jib are connected, the boom is typically positioned near the ground and the jib is positioned in-line with the boom. Once the boom and the jib are connected, the boom may be raised lifting the jib. The jib may then be angled down, and a stop may be installed to prevent the jib from extending in line with the boom. If the jib were to extending in line with the boom, it may damage the jib, tip the crane, or damage the boom. The jib stop provides a backup safety measure to ensure the jib does not extend in line with the boom during operation.

BRIEF SUMMARY

In one aspect, a stop assembly for a crane is disclosed. The stop assembly includes an elongated body having a first connector at a first end configured to couple to a first crane member and an interface at a second end configured to interface with a second crane member; and a gravity actuated mechanism disposed on the body. The gravity actuated mechanism has a first configuration in which gravity actuated mechanism disables the interface, and a second configuration in which the gravity actuated mechanism does not disable the interface, and the gravity actuated mechanism is automatically changeable from the first configuration to the second configuration as the body is moved from a first orientation relative to a horizontal plane to a second orientation relative to the horizontal plane.

In some embodiments, the gravity actuated mechanism includes a weighted portion, a lock arm coupled to the weighted portion, and a latch pivotably coupled to the body. The latch is pivotable between a latched position and an unlatched position, and the lock arm is engaged with the latch when the gravity actuated mechanism is in the first configuration and the latch is in the latched position. In some embodiments, the stop assembly further includes a biasing member biasing the latch toward the latched position.

In some embodiments, the interface is a pocket sized and shaped to receive a portion of the second crane member. In some embodiments the pocket is sized and shaped to receive a stop lug of the second crane member. In some embodiments, the body defines a longitudinal axis and when the body is in the first position and the gravity actuated mechanism is in the first configuration the longitudinal axis lies substantially in the horizontal plane.

In some embodiments, the interface does not interact with the second crane member in the first configuration and does interact with the second crane member in the second configuration.

In some embodiments, the movement of the stop assembly towards the second crane member causes the stop assembly to displace when the gravity actuated mechanism is in the first configuration.

In another aspect a support column assembly for a crane is disclosed. The support column assembly includes a first support column having a first end; a second support column having a second end pivotably attached to the first end of the first support column; and a gravity actuated stop member coupled to the first column and having an interface configured to interact with the second crane member. The gravity actuated stop member has a first configuration in which the interface is not actuated and a second configuration in which the interface is actuated. The gravity actuated mechanism is automatically changeable from the first configuration to the second configuration as the body is moved from a first position relative to a horizontal plane to the second position relative to a horizontal plane.

In some embodiments, the gravity actuated stop member has a gravity actuated mechanism having a weighted portion, a lock arm coupled to the weighted portion, and a latch pivotably coupled to the body. The latch is pivotable between a latched position obstructing the interface and an unlatched position. The lock arm is engaged with the latch when the gravity actuated stop member is in the first configuration and the latch is in the latched position. In some embodiments, the gravity actuated mechanism further includes a biasing member biasing the latch toward the latched position In some embodiments, the second crane component includes a lug and the interface comprises a pocket sized and shaped to receive the lug.

In some embodiments, the gravity actuated stop member defines a longitudinal axis and the gravity actuated stop member is in the first position and in the first configuration when the longitudinal axis lies substantially in the horizontal plane.

In some embodiments, the interface does not interact with the second support column in the first configuration and does interact with the second support column in the second configuration.

In some embodiments, movement of the gravity actuated stop member towards the second support column assembly causes the gravity actuated stop member to displace when the locking mechanism is in the first configuration.

In another aspect a stop assembly for a crane includes an elongated body having an aperture at a first end, the aperture sized and shaped to receive a pin for connection to a first crane member, and a second end having pocket sized and shaped to receive a lug of a second crane member; and a latch disposed at the second end of the elongated body. The latch has a first pivoting connection coupling the latch to the elongated body. The latch is pivotable from a first latch position wherein the latch obstructs the pocket and a second latch position wherein the latch does not obstruct the pocket. A lock assembly has a second pivoting connection spaced from the first pivoting connection and pivotally couples the lock assembly with the elongated body and has a center of gravity offset from the second pivoting connection. The lock assembly has a lock arm extending radially away from the second pivoting connection, and rotates from a first lock position wherein the lock arm engages the latch in the first latch position to a second lock position in which the lock arm does not engage the latch in the first latch position. A biasing member is coupled to the latch and the elongated member, the biasing member biases the latch to the first latch position.

In some embodiments, the lock assembly comprises the lock arm and a weighted portion coupled to the lock arm. In some embodiments, the offset center of gravity biases the lock assembly to the first position when the elongated body is in a horizontal orientation. In some embodiments, the offset center of gravity biases the lock assembly to the second position when the elongated body is in a non-horizontal orientation. In some embodiments, the latch in the first position forms a second interface configured to guide the first interface of the stop assembly past the lug of the second crane member.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Several terms used in the specification and claims have a meaning defined as follows.

The term "crane member" is used to designate a structural component of a crane and includes components such as a boom, jib, strut, mast, and components thereof.

The term "horizontal" is used in reference to a direction parallel to the horizon and that is perpendicular to the gravitational acceleration vector.

The term "support column" is used to designate a structural support column in a crane such as a boom, jib, or mast.

The gravity actuated stop is a stop assembly designed to selectively inhibit a crane component, such as a boom or jib, from rotating into a particular orientation. The selection of whether the crane component is able to rotate into a particular orientation is determined by the horizontal orientation of the gravity actuated stop. In one common embodiment, the gravity actuated stop may be a jib stop that inhibits a jib from extending in line with a boom when the jib stop is away from horizontal, but allows the jib to be in line with the boom when the jib stop is near horizontal. Of course, variations of the gravity actuated stop may be used elsewhere to selectively inhibit motion of a crane component depending on its orientation, such as a stop on a mast, or a stop on a boom.

Figure 1:
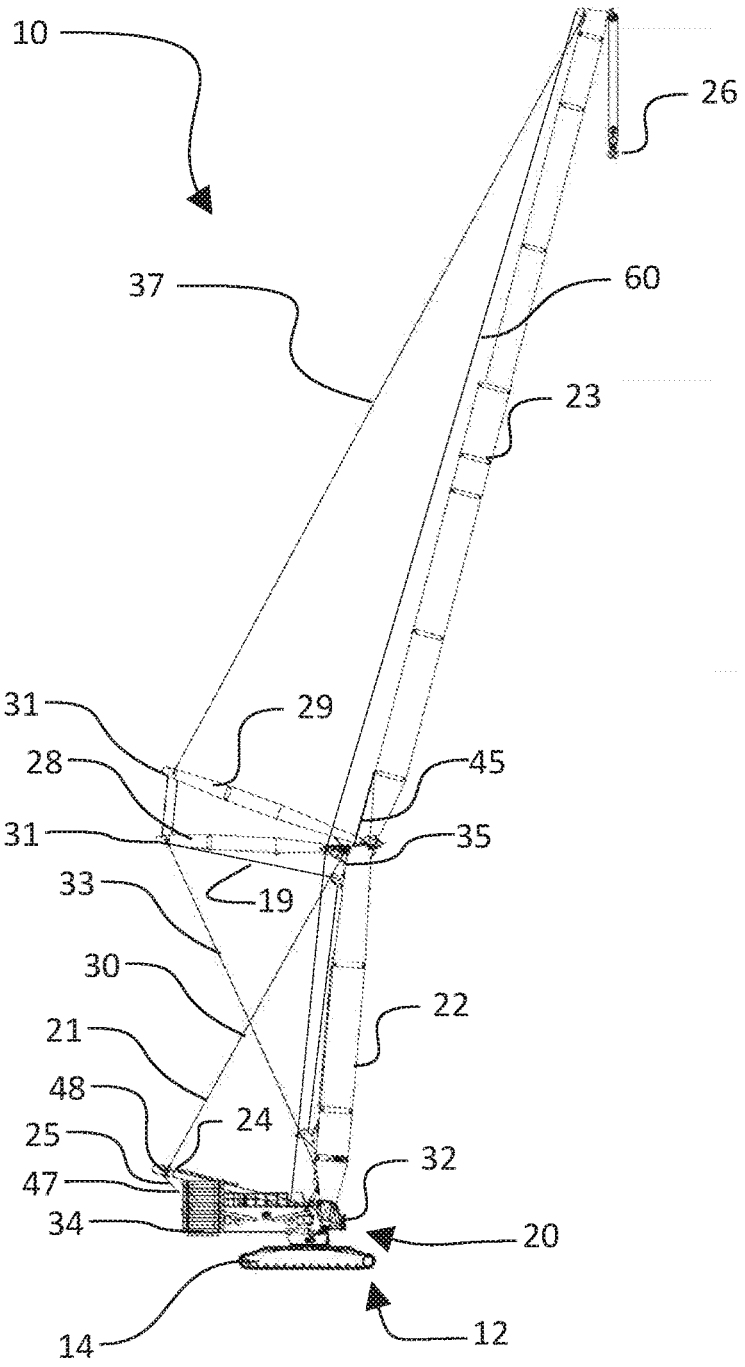
FIG. 1 is a side elevational view of a mobile lift crane.

While the invention will have applicability to many types of cranes, it will be described in connection with mobile lift crane 10, shown in an operational configuration in FIG. 1. The mobile lift crane 10 includes lower works, also referred to as a carbody 12, and moveable ground engaging members in the form of crawlers 14. There are two crawlers 14 on either side of the crane 10, only one of which can be seen from the side views of FIG. 1. In the crane 10, the ground engaging members could be multiple sets of crawlers, one set of crawlers on each side. Of course additional crawlers than those shown can be used, as well-as other types of ground engaging members, such as tires.

A rotating bed 20 is mounted to the carbody 12 with a slewing ring, such that the rotating bed 20 can swing about an axis with respect to the ground engaging members 14. The rotating bed 20 supports a boom 22 pivotally mounted on a front portion of the rotating bed 20; a mast 24 mounted at its first end on the rotating bed 20, equalizer rigging 47 connected to the mast 24 adjacent a second end of the mast 24; and a counterweight unit 34. The counterweight unit 34 may be in the form of multiple stacks of individual counterweight members on a support member.

Boom hoist rigging 30 between the top of mast 24 and boom 22 is used to control the boom angle and transfer load so that the counterweight unit 34 can be used to balance a load lifted by the crane 10. A load hoist line 60 is trained over a pulley (usually multiple sheaves in a sheave set) on the boom 22, supporting a hook 26. At the other end, the load hoist line 60 is wound on a first main load hoist drum (not shown) connected to the rotating bed 20. The rotating bed 20 includes other elements commonly found on a mobile lift crane, such as an operator's cab 32, hoist drum for the boom hoist rigging 30, a second main hoist drum and an auxiliary load hoist drum and a whip line. If desired, and as shown in FIG. 1, the boom 22 may comprise a luffing jib 23 pivotally mounted to the top of the main boom 22, or other boom configurations. When a luffing jib 23 is included, the crane 10 may include a gravity actuated stop member in the form of jib stop 45, as well as a first jib strut 28 and a second jib strut 29 and associated luffing jib rigging including a luffing jib hoist drum. Luffing jib hoist line 19 runs from a drum and up to the rigging between sheaves in strut caps 31, and is used to control the angle between the first jib strut 28 and the second jib strut 29. Jib backstay straps 33 run between the first jib strut 28 and the bottom of the boom 22, creating a fixed angle between the boom 22 and the first jib strut 28. Likewise jib support straps 37 connect the end of the luffing jib 23 and the second jib strut 29, creating a fixed angle between those two members. Thus, the angle between the second jib strut 29 and first jib strut 28 also defines the angle that the luffing jib 23 makes with the main boom 22. A strut stop 35 is connected between the first second jib strut 29 and the boom 22 to provide support to the first jib strut 29 if no load is on the jib 23 and the forces pulling the first jib strut 29 up are less than the forces pulling the first jib strut 29 down. While not discussed further herein, the strut stop 35 may be configured like the stop member used for the boom stop 15 and jib stop 45 described in detail below.

The boom hoist rigging 30 includes a boom hoist line in the form of wire rope 25 wound on a boom hoist drum (not shown), and reeved through sheaves on a lower equalizer (not shown) and an upper equalizer 48. The boom hoist rigging also includes fixed length pendants 21 connected between the boom top and the upper equalizer 48. The lower equalizer is connected to the rotating bed 20. This arrangement allows rotation of the boom hoist drum 50 to change the amount of boom hoist line 25 between the lower equalizer and the upper equalizer 48, thereby changing the angle between the rotating bed 20 and the mast 24, which causes the boom to move through the fixed length pendants 21.

While each stop is shown as a single member, preferably the crane 10 includes stops in sets of two. However, each of the stops in the set of two is nearly identical, and placed on the crane 10 such that only one of them can be seen from the side views of FIG. 1. Further description of the stops will be done in reference to jib stop 45, but it will be understood that multiple stops may be used and the description is applicable to other stops on the crane 10, both those explicitly called out in FIG. 1, as well as other stops which may not be explicitly illustrated in FIG. 1.

Figure 2:
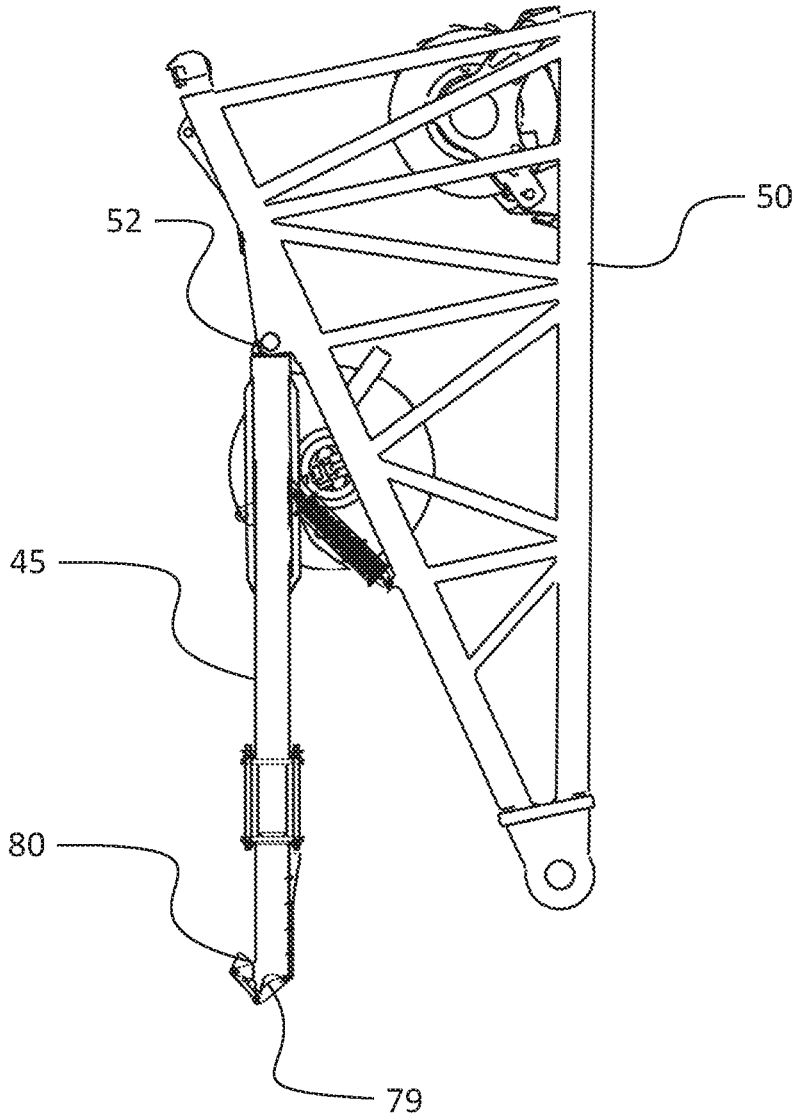
FIG. 2 is an enlarged side view of a butt section of a jib.

FIG. 2 illustrates a jib stop 45 mounted to a butt segment 50 of a jib 23. The jib stop 45 is mounted to the butt segment 50 through a pinned connection 52. The jib 23 may have a structure offsetting the mounting point of the jib stop 45, or it may be connected through a different type of connection. The boom 22 includes a jib stop engagement member (not shown in this view) and the jib stop 45 includes an interface in the form of U-shaped member 79 shaped and sized to engage the jib stop engagement member. Of course the jib stop 45 may be opposite of that shown in FIG. 2 as well, with the pinned connection attached to the boom and the jib stop engagement member disposed on the jib. As will be shown in greater detail, the jib stop 45 includes a gravity actuated mechanism 80 that is configured to selectively activate the interface 79 depending on the orientation of the jib stop 45.

The jib stop 45 inhibits the jib 23 from approaching an orientation in line with the boom 22. As the jib 23 approaches an inline orientation, the second end of the jib stop 45 engages the jib stop engagement member preventing further rotation of the jib 23 relative to the boom 22. The jib stop 45 may be compressible, in which case the jib 23 may continue to rotate towards an inline orientation, but the resistance to rotation will increase as the jib stop 45 is compressed.

Figure 3:
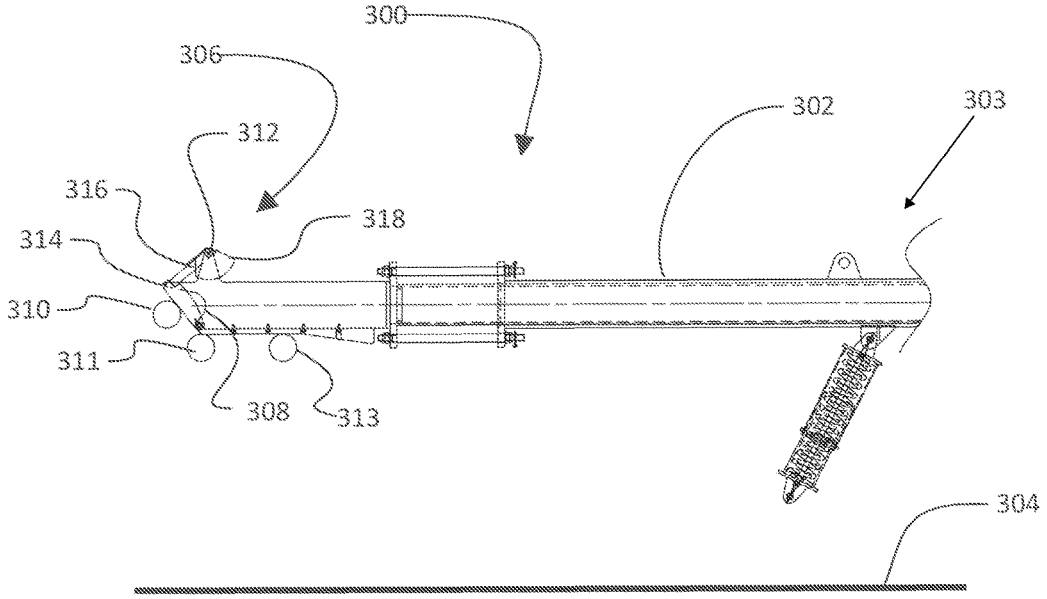
FIG. 3 is a side view of a stop mechanism in which an interface is disabled.

FIG. 3 illustrates a detailed view of a gravity actuated stop assembly for a crane in the form of a jib stop 300. In this embodiment, the jib stop 300 has an elongated body 302 that is angularly moveable relative to the horizontal plane 304. The body 302 has a first connector in the form of a pin for pinning to a crane member such as a jib at a first end 303 and the body's angular position may be dependent on the orientation pinned crane member. At a second end 306 of the body 302 is an interface 308 for interfacing with a second crane member such as a boom having a jib stop engagement member in the form of a lug 310. Near the second end 306 is a gravity-actuated mechanism 312 disposed on the body. The gravity actuated mechanism 312 has at least two configurations dependent upon the orientation of the body 302 relative to the horizontal plane 304.

The gravity-actuated mechanism 312 has a first configuration in which the interface 308 is disabled, and a second configuration in which the interface 308 is not disabled. The gravity-actuated mechanism 312 is automatically changeable from the first configuration to the second configuration as the body 302 is moved from a first position to a second position. In the embodiment shown in FIG. 3, the first position corresponds to the elongated axis of the jib stop 300 being orientated parallel to the horizontal plane 304, and the second position corresponds to the elongated axis of the jib stop 300 being orientated away from the horizontal plane 304. In other embodiments, the positions could vary, such as the first position corresponding to the elongated axis of the body 302 being orientated vertically, and the second position being the elongated axis of the body 302 orientated away from vertical.

When the interface 308 is disabled, it limited interaction, if any with the jib stop engagement member of the second crane member. FIG. 3 illustrates the interface 308 in a disabled. In this example, the interface 308 comprises a pocket sized and shaped to receive a lug 310 coupled to the second crane member. A latch 314 is rotatably attached to a lower portion of the elongated body 302 near the interface 308 and moves between a latched position in which the latch 314 prevents engagement of the lug 310 with the pocket, and an unlatched position in which it does not affect the engagement of lug 310 with the pocket. The latch 314 may obstruct the pocket in the latched position such that the lug 310 is unable to enter the pocket. The latch 314 may have a pivoting connection, such as hinged connection, such that the latch 314 is pivotable between the latched position and the unlatched position. A lock assembly may have a lock arm 316 coupled to a weighted portion 318 that is rotatably attached to the body 308. The weighted portion 318 has a center of gravity that is offset from the rotatable attachment, such that the weighted portion 318 is biased to maintain a set position with respect to the horizontal plane 304. As the body 302 rotates relative to the horizontal plane 304, the weighted portion 318 is biased to maintain its original orientation, causing it to rotate relative to the body 302. In FIG. 2, the body 302 is generally horizontal and the lock arm 316 is biased to rotate into a position in which the lock arm 316 engages the latch 314, preventing the latch 314 from moving from the latched position into the unlatched position.

In FIG. 3, movement of the stop lug 310 towards the interface 308 results in the stop lug 310 engaging the latch 314. Because the latch 314 is held in the latched position by the lock arm 316, the stop lug 310 forces the second end 306 of the jib stop 300 to displace as it encounters the latch 314, which acts as an inclined plane. The interface 308 of the jib stop 300 is able to move past the lug 310, as shown by lug 311, and lug 313. In this configuration, the jib may be attached to the boom without interference that would normally be caused by the jib stop when the jib is in line with the boom.

Figure 4:
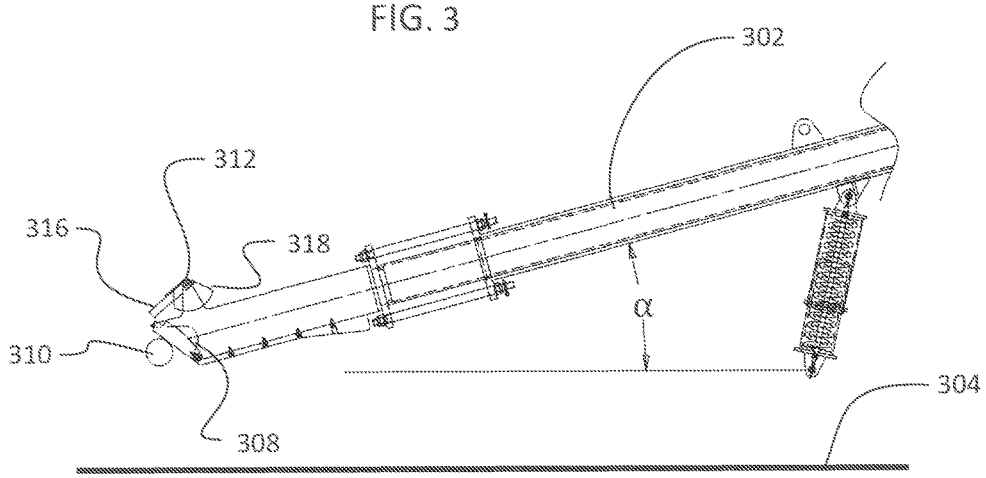
FIG. 4 is a side view of the stop mechanism of FIG. 3 in which the interface is not disabled.

In FIG. 4, the gravity-actuated mechanism 312 is shown in a second configuration in which the interface 308 is not disabled. In FIG. 4, the body 302 has been rotated such that its elongated axis is at angle $\alpha$ with respect to the horizontal plane 304. The weighted portion 318 and the lock arm 316 maintain their position relative to the horizontal 304, but move relative to the body 302 such that the lock arm 316 rotates away from the latch 314 and no longer engages with the latch 314. The latch 314 is biased to return to the position shown in FIG. 4, such that the lock arm 316 may reengage the latch 314 when the body 302 is returned to a horizontal orientation. Absent any other forces, the latch 314 will remain in the position shown in FIG. 4. The latch 314 may be biased by a biasing member such as a spring.

Figure 5:
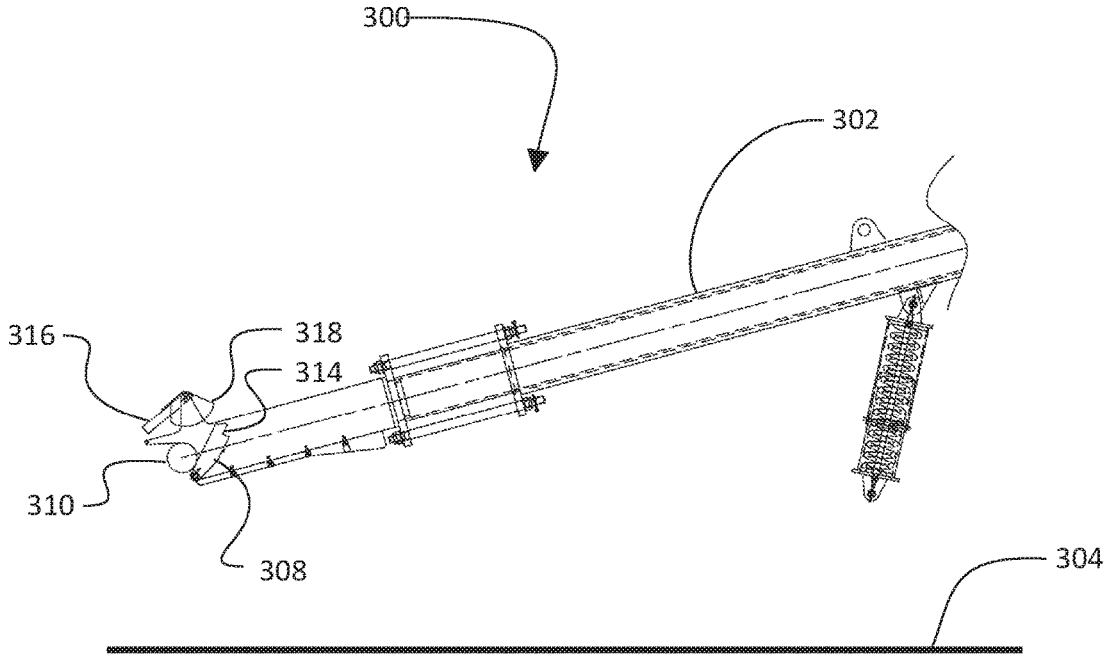
FIG. 5 is a side view of the stop mechanism of FIG. 4 in which the interface is not disabled and the interface is engaged with a portion of a crane component.

In FIG. 5, the interface 308 is in the second configuration, as in FIG. 4, but the stop lug 310 has engaged with the stop member 300. The movement of the stop lug 310 forces the latch 314 to rotate against the bias and exposes the interface 308 of the jib stop 300. The lug 310 may continue to move towards the interface 308 forcing the latch 314 open further until the lug 310 contacts the interface 308. With the lug 310 in contact with the interface 308, the jib stop inhibits further motion between the boom and the jib. The pocket of the interface 308 may have a recessed center portion for receiving the stop lug 310 with extended portions on either side of the recessed portion to guide the stop lug 310. The extended portions guide the stop lug 310 into the recess and additionally help to hold the jib stop in position relative to the stop lug 310.

With the stop member 300 in the orientation shown in FIG. 5, the rotation of the first crane member relative to the second crane member is inhibited in a first direction, but not in the opposite direction. When the second crane member is rotated in the second direction, the stop lug 310 moves away from the interface 308 and the latch 314 rotates back towards the latched position until it returns to the orientation shown in FIG. 4. Because the lock arm 316 is still biased by the weighted portion 318 away from the latch 314, the latch 314 is free to return to the unlatched position if the second crane member rotates in the first direction again.

When the stop member 300 returns to the orientation shown in FIG. 3, the lock arm 316 is biased by the weighted portion 318 to engage with the latch 316 again. If the interface 308 is not inhibiting further motion of the second crane member relative to the first crane member, the lock arm 316 engages the latch 314 and disables the interface 308 again. If the latch 314 is in the unlatched position and the interface 308 is inhibiting further motion of the second crane member relative to the first crane member, the lock arm 316 may rest against the latch 314 in the unlatched position. As the stop engagement member disengages from the interface 308, the latch 314 returns to the latched position, at which point the lock arm 316 engages the latch 314 again, disabling the interface 308.

It should be understood that various changes and modifications to the presently preferred embodiments described herein may be made. For example, the first and second crane members need not be a boom and a jib. For example, the first crane member could be the rotating bed of the crane. Additionally, in some embodiments the angle at which the gravity actuated mechanism changes configurations may be other than horizontal. Such changes and modifications can be made without departing from the spirit and scope of the present invention and without diminishing its intended advantages. It is therefore intended that such changes and modifications be covered by the appended claims.

The invention claimed is:

1. A stop assembly for a crane comprising:

an elongated body having a first connector at a first end configured to couple to a first crane member and an interface at a second end configured to interface with a second crane member; and a gravity actuated mechanism disposed on the elongated body, the gravity actuated mechanism having a first configuration in which the gravity actuated mechanism disables the interface, and a second configuration in which the gravity actuated mechanism does not disable the interface, wherein the gravity actuated mechanism is automatically changeable from the first configuration to the second configuration as the elongated body is moved from a first orientation relative to a horizontal plane to a second orientation relative to the horizontal plane, wherein the gravity actuated mechanism comprises a weighted portion, a lock arm coupled to the weighted portion, and a latch pivotably coupled to the elongated body, the latch is pivotable between a latched position and an unlatched position, wherein the lock arm is engaged with the latch when the gravity actuated mechanism is in the first configuration and the latch is in the latched position.

2. The stop assembly of claim 1, further comprising a biasing member biasing the latch toward the latched position.

3. The stop assembly of claim 1, wherein the interface comprises a pocket sized and shaped to receive a portion of the second crane member.

4. The stop assembly of claim 3, wherein the pocket is sized and shaped to receive a stop lug of the second crane member.

5. The stop assembly of claim 1, wherein the elongated body defines a longitudinal axis and wherein the elongated body is in a first position and the gravity actuated mechanism is in the first configuration when the longitudinal axis lies substantially in the horizontal plane.

6. The stop assembly of claim 1, wherein the interface does not interact with the second crane member in the first configuration and does interact with the second crane member in the second configuration.

7. The stop assembly of claim 1, wherein movement of the stop assembly towards the second crane member causes the stop assembly to displace when the gravity actuated mechanism is in the first configuration.

8. A support column assembly for a crane, comprising:

a first support column having a first end;

a second support column having a second end pivotably attached to the first end of the first support column;

a gravity actuated stop member coupled to the first support column and having an interface configured to interact with the second support column, wherein the gravity actuated stop member has a first configuration in which the interface is not actuated and a second configuration in which the interface is actuated, wherein the gravity actuated stop member is automatically changeable from the first configuration to the second configuration as the first support column is moved from a first position relative to a horizontal plane to a second position relative to the horizontal plane, wherein the gravity actuated stop member comprises a gravity actuated mechanism having a weighted portion, a lock arm coupled to the weighted portion, and a latch pivotably coupled to the first support column, the latch pivotable between a latched position obstructing the interface and an unlatched position, wherein the lock arm is engaged with the latch when the gravity actuated stop member is in the first configuration and the latch is in the latched position.

9. The support column assembly of claim 8, wherein the gravity actuated stop member further comprises a biasing member biasing the latch toward the latched position.

10. The support column assembly of claim 8, wherein the second support column further comprises a lug and the interface comprises a pocket sized and shaped to receive the lug.

11. The support column assembly of claim 8, wherein the gravity actuated stop member defines a longitudinal axis and wherein the gravity actuated stop member is in the first position and in the first configuration when the longitudinal axis lies substantially in the horizontal plane.

12. The support column assembly of claim 8, wherein the interface does not interact with the second support column in the first configuration and does interact with the second support column in the second configuration.

13. The crane member of claim 8, wherein movement of the gravity actuated stop member towards the second support column causes the gravity actuated stop member to displace when the gravity actuated stop member is in the first configuration.

14. A stop assembly for a crane comprising:

an elongated body having an aperture at a first end, the aperture sized and shaped to receive a pin for connection to a first crane member, and a second end having a pocket sized and shaped to receive a lug of a second crane member; and a latch disposed at the second end of the elongated body, the latch having a first pivoting connection coupling the latch to the elongated body, the latch being pivotable from a first latch position wherein the latch obstructs the pocket and a second latch position wherein the latch does not obstruct the pocket;

a lock assembly having a second pivoting connection spaced from the first pivoting connection and pivotally coupling the lock assembly with the elongated body and having a center of gravity offset from the second pivoting connection, the lock assembly having a lock arm extending radially away from the second pivoting connection, the lock arm rotating from a first lock position wherein the lock arm engages the latch in the first latch position to a second lock position wherein the lock arm does not engage the latch in the first latch position; and a biasing member coupled to the latch and to the elongated body, the biasing member biasing the latch to the first latch position.

15. The stop assembly of claim 14, wherein the lock assembly comprises a weighted portion coupled to the lock arm.

16. The stop assembly of claim 14, wherein the center of gravity biases the lock arm toward the first lock position when the elongated body is in a horizontal orientation.

17. The stop assembly of claim 14, wherein the center of gravity biases the lock arm toward the second lock position when the elongated body is in a non-horizontal orientation.

18. The stop assembly of claim 14, wherein the latch in the first latch position forms a second interface configured to guide a first interface of the stop assembly past the lug of the second crane member.

* * * * *